US006648997B2

(12) United States Patent
Stratton

(10) Patent No.: US 6,648,997 B2
(45) Date of Patent: Nov. 18, 2003

(54) QUENCHING METHOD

(75) Inventor: Paul Francis Stratton, Huddersfield (GB)

(73) Assignee: The BOC Group, plc, Windlesham (GB)

( * ) Notice: Subject to any disclaimer, the term of this patent is extended or adjusted under 35 U.S.C. 154(b) by 0 days.

(21) Appl. No.: 09/909,637

(22) Filed: Jul. 20, 2001

(65) Prior Publication Data

US 2002/0062888 A1 May 30, 2002

(30) Foreign Application Priority Data

Jul. 26, 2000 (GB) ..... 0018389

(51) Int. Cl.[7] ..... C21D 1/56
(52) U.S. Cl. ..... 148/660; 148/638
(58) Field of Search ..... 148/660, 638

(56) References Cited

U.S. PATENT DOCUMENTS

| | | | | |
|---|---|---|---|---|
| 2,910,395 A | | 10/1959 | Stratton | |
| 4,243,439 A | | 1/1981 | Rauch | 148/20.6 |
| 5,681,407 A | | 10/1997 | Yu et al. | |

FOREIGN PATENT DOCUMENTS

| | | | |
|---|---|---|---|
| GB | 986756 | 7/1963 | |
| GB | WO 94/26939 | 11/1994 | C21D/1/56 |
| JP | 580039727 A | 3/1983 | C21D/1/00 |
| JP | 010100217 A | 4/1989 | C21D/1/60 |
| JP | 030064421 A | 3/1991 | C21D/9/573 |
| RO | 72868 A | 12/1980 | C21D/1/60 |
| WO | WO 00/17405 A1 | 3/2000 | C21D/9/573 |

OTHER PUBLICATIONS

Patent Abstracts of Japan, vol. 013, No. 315 (C–619), Jul. 18, 1989, & JP 01 100217 A (Idemitsu Kosan Co. Ltd., Apr. 18, 1989.

Database WPI, Section Ch, Week 198214, Derwent Publications, Ltd. London, GB; Class A97, AN 1982–003543, XP002194478 and RO 72 868 A (Inst. Tehn. Sect. Cald.), Dec. 8, 1980.

*Primary Examiner*—Deborah Yee
(74) *Attorney, Agent, or Firm*—Joshua L. Cohen

(57) ABSTRACT

Objects formed of engineering and tool steels are quenched from above 850° C. by immersion in an aqueous suspension of inorganic particles. The greater the proportion of particles, the slower the quench. The suspension may be saturated with carbon dioxide.

5 Claims, 2 Drawing Sheets

QUENCHING METHOD

BACKGROUND OF THE INVENTION

This invention relates to a method of quenching a hot metal object, particularly one made of steel.

The thermal quenching of hot metal objects is a required step in many heat treatment processes such as, for example, annealing, hardening, case hardening, carburising, or nitrocarburisation of steel objects. Typically the metal object is cooled by thermal quenching from a temperature of 850° C. or above to a temperature of less than 100° C.

Water has been used as a thermal quenchant, but by itself, provides too rapid a quenching in most examples of the heat treatment of engineering steels with the result that distortion of the object or internal damage to it is caused.

It is therefore far more common to employ an oil as the thermal quenchant in a heat treatment process. Several disadvantages arise from such use of an oil. Prime among these is that oil would pollute the environment and therefore presents a disposal problem when it is no longer fit for further use. Further, oils tend to give rise to noxious fumes and can present a fire hazard. In addition, the oil needs to be washed off the metal object at the end of the thermal quenching step.

Attempts have therefore been made to find alternative thermal quenchants to water alone and to oils.

It is known, for example, to dissolve water soluble organic substances such as a polyvinyl alcohol, an alkylene glycol, or glycerol in an aqueous thermal quenchant so as to reduce the intensity of the quench. Although such materials are non-flammable and do not give off any fumes in use, they still represent an end-of-life disposal problem.

GB-A-986 756 relates to the cooling of a hot solid body in a fluidised bed, that is a moving bed, of solid metallic particles. The bed is fluidised by means of a stream of liquid, typically water, at ambient temperature. The fluidised particles disrupt an insulating vapour film that forms around the body to be cooled and therefore enhances the cooling rate. Other documents also disclose the cooling of hot articles by means of a fluidised bed of particles. One example of such a document is JP-A-306 4421 which discloses the cooling of hot steel wire rod by means of a fluidised bed of metal particles. Another example is WO-A-00/17405 which discloses the cooling of steel wire by means of a fluidised bed of oxide particles.

JP-A-1100 217 discloses a quenching agent consisting of water, polyethylene glycol, and colloidal silica. The quenching agent shortens the vapour film stage during the formation of martensite in a steel article.

U.S. Pat. No. 4,243,439 employs a quenching medium comprising coaqueous suspension of a binder and a pulverulent filler component selectively to modify the density, viscosity and heat conductivity of the medium for use in the quenching of aluminium alloys from 525° C. According to the teaching of U.S. Pat. No. 4,243,439, the presence of the solid suspended particles opposes the establishment or the stabilisation of an insulating calefaction film on the surface of the castings.

U.S. Pat. No. 5,681,407 discloses a method of quenching a wrought metal object formed of aluminium, iron, magnesium or an alloy thereof in which a liquid quenchant (typically water) is employed. The liquid quenchant has a gas such as carbon dioxide deliberately pre-dissolved in it. The gas does not cause any disposal problem, and does have some effect in lowering the quench rate. Nonetheless, this method still seems unsatisfactory for many engineering steels in that the maximum cooling rate is too high, as is the cooling rate at the temperature (about 300° C.) at which martensite forms.

There are two problems which need to be solved. First, there is a need for a thermal quenching medium ("a quenchant") which gives the operator some degree of control over the cooling rate for a given quenchant temperature. Second, in the case of engineering and other steels, there is the need to find a quenchant which makes possible lower cooling rates, particularly at temperatures in the order of 300° C., without giving rise to any serious disposal problem.

It is therefore an aim of the invention to address these problems.

SUMMARY OF THE INVENTION

According to the present invention there is provided a method of quenching a hot metal object formed of steel, the method including immersing the hot metal object in a suspension of an essentially insoluble inorganic particulate material in water, the suspension being initially at a temperature below 100° C.

The method according to the invention is suitable for treatment of alloys such as engineering steels that undergo an austenite-martensite transition during quenching or otherwise require a relatively slow cooling rate. In addition, the method is particularly suitable for treatment of high alloyed steels or tool steels which do not require a fast initial cooling rate and which would crack if cooled too quickly. Examples of such steels are molybdenum or tungsten high speed tool steels. The quenchant also has the advantage of not causing any substantial disposal problems.

The method according to the invention will now be described further by way of reference to the following example and the following drawings, in which.

DETAILED DESCRIPTION OF THE INVENTION

Figure 1:
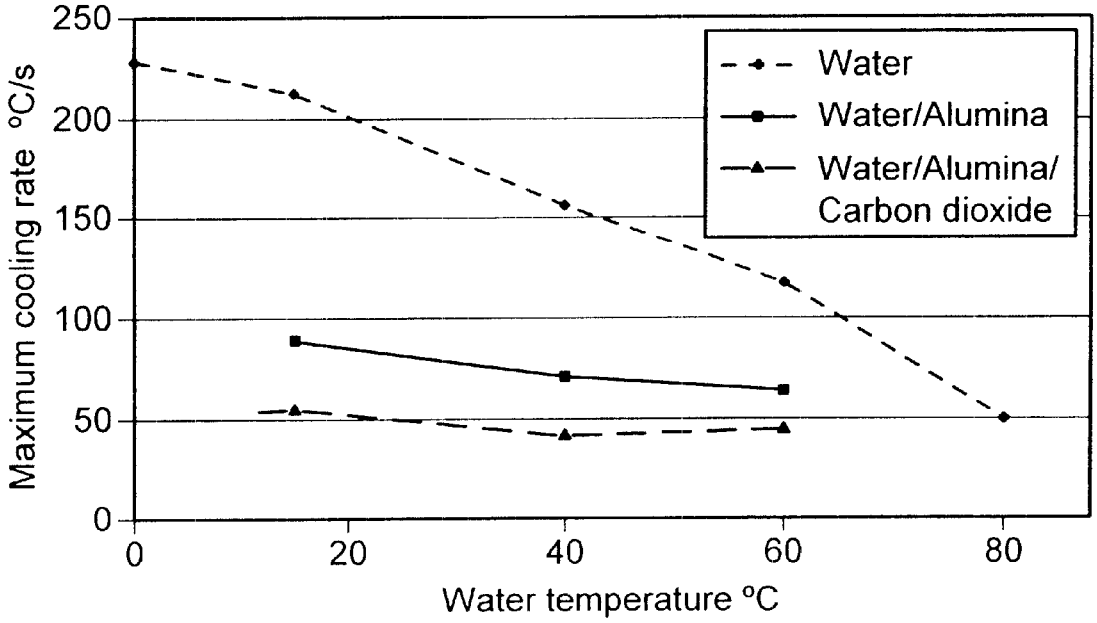
FIG. 1 is a graph comparing at different quenchant temperatures maximum cooling rates for a simple water quenchant and two quenchants for use according to the invention.

The quenching rate can be selected by choosing the amount of the particulate material present per unit volume of water. The greater this amount, the lower the quenching rate. We believe that in a static system, with no agitation or displacement of either the water or the metal object, the inorganic particulate material helps to stabilise a vapour film around the surface of the article being cooled and thereby enhance the quench rate. Quenching rates can be further reduced if a readily soluble gas, such as carbon dioxide is dissolved, preferably pre-dissolved, in the suspension. Typically, the suspension is saturated with the readily soluble gas. Surprisingly, the gas does not disrupt the vapour film.

The particulate material is preferably finely divided. Essentially all the particles preferably have a size in the range of 0.01 to 10 microns. (One micron=0.001 mm). The particulate material preferably has a density in the range of 1 to 5 g/cm$^3$.

Desiderata for the selection of the particulate material are that it should be inert in the conditions to which it is subjected in the method and use according to the invention, and that it should also be non-toxic and non-carcinogenic. Ceramic materials, for example, oxides, nitrides and borides are generally suitable for use as the particulate material. Various forms of alumina, especially gamma—alumina, are particularly suitable.

Preferably for each one hundred grammes of water, there are from 1 to 12 grammes, more preferably from 2 to 8 grammes, of the particulate material in the suspension.

Carbon dioxide is very much the preferred gas for dissolving in the suspension. It is copiously soluble in water. Other gases tend to be toxic or are relatively sparingly soluble. Sulphur dioxide comes into the former category; nitrogen into the latter.

The suspension of the inorganic particulate material in the water will normally be held in a bath which is of sufficient capacity to receive the metal object to be quenched and which is open to the atmosphere. The quenching is therefore preferably performed at atmospheric pressure.

The suspension of the inorganic particulate material is preferably held at ambient temperature prior to contact with the metal object to be quenched but, if desired, may be at a lower temperature or higher temperature. Generally, a temperature in the range of 5° C. to 50° C. is preferred.

The period of time for which the metal object is immersed depends on the cooling rate and the final temperature to which the metal object is to be quenched. Typically, this period will be from 30 seconds to 10 minutes in duration.

If desired, a biocide may be dissolved in the suspension.

EXAMPLE

The following experiments were performed using a test workpiece (also referred to as a "probe") of inconel (TM) alloy 200 steel. The test workpiece took the form of standard Wolfson quench probe equipment supplied by Drayton Probe Systems of Trentham, Stoke-On-Trent, Staffordshire, UK under the trade mark "QuenchMaster" conforming to the proposed international standard (ISO/DIS 9950 draft). The probe was heated to an internal temperature of approximately but not less than 850° C. and was immersed in an open bath of chosen quenchant. The experiments were performed on a static system. There was no translation of the probe from its immersion until the cooling was complete. The bath was also static, i.e. there was no vigorous agitation or vigorous stirring of the water.

In a first experiment, the maximum workpiece cooling rate was measured at several quenchant temperatures in the range 0 to 80° C., the quenchant being degassed water.

In a second experiment, the maximum workpiece cooling rate was measured at three different quenchant temperatures in the range 15 to 60° C., the quenchant being a suspension of 0.05 micron particles of gamma-alumina in water having a weight ratio of gamma-aluminium to water of 0.044 to 1. The suspension was formed by diluting a commercial suspension supplied by Leco Instruments, Stockport, Cheshire.

In a third experiment, the maximum workpiece cooling rate was measured at four different quenchant temperatures in the range of 0 to 60° C., employing the same quenchant as in the second experiment, same that the water was saturated with carbon dioxide by bubbling carbon dioxide through the bath for a period of twenty minutes prior to immersion of the workpiece in the quenchant.

The results of the three experiments are shown in FIG. 1. The maximum cooling rates obtained at temperatures up to and including 60° C. were substantially lower in the alumina/water and alumina/water/carbon dioxide quenchants than in the simple water quenchant. In general, quenchant temperatures above 60° C. are less preferred because difficulties can arise with excessive steam generation as the temperature of the quenchant prior to immersion of the hot workpiece becomes closer to the boiling point of water.

When the third phase (dissolved carbon dioxide) was introduced, it was found that the effects of the carbon dioxide and the alumina in diminishing the maximum cooling rate were essentially additive.

Figure 2:
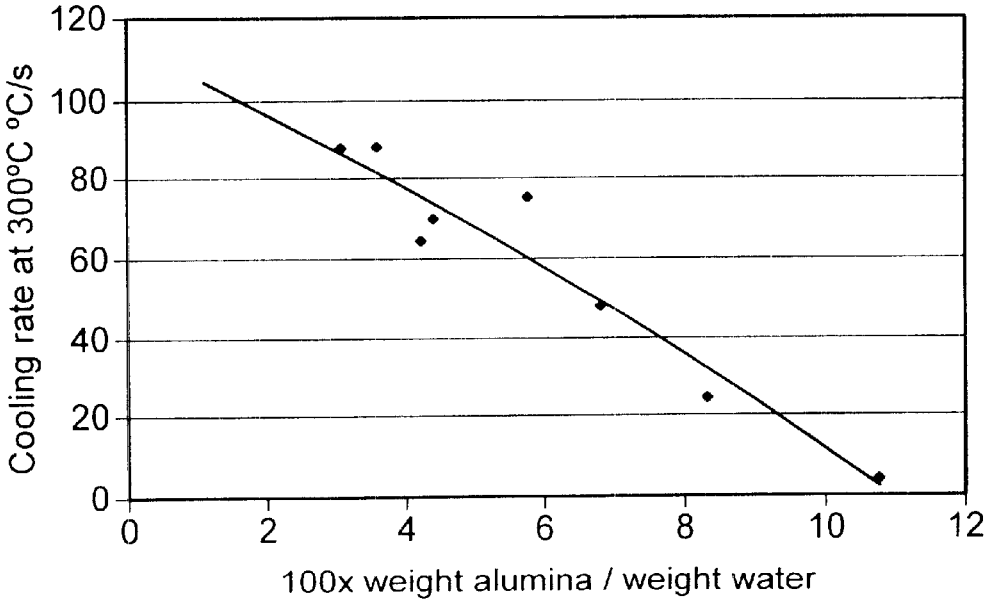
FIG. 2 is a graph showing the effect of the amount of inert particulate material in the suspension on the cooling rate at 300° C.
Figure 3:
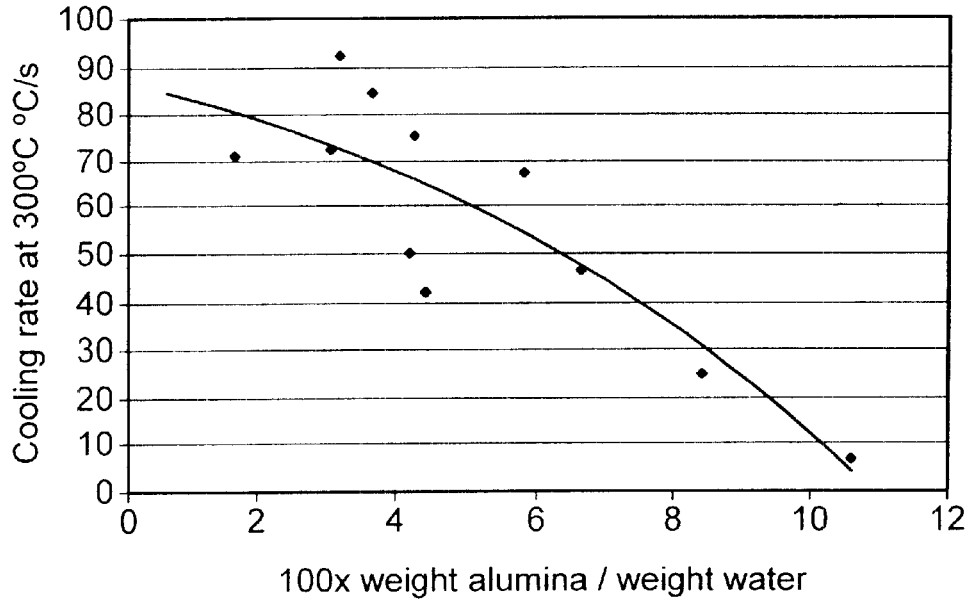
FIG. 3 is a graph similar to FIG. 2 showing the same effect when the suspension is saturated with carbon dioxide.

In a second set of experiments, the effect on the cooling rate at 300° C. of various different weight ratios of gamma-alumina to water was investigated at an initial quenchant temperature of 40° C. The results obtained are presented in graphical form in FIG. 2. It was found that, within the range investigated (approximately 0.01:1 to 0.11:1), the cooling rate fell with increasing alumina concentration from over 100° C./s to less than 10° C./s. The experiments were repeated with a suspension of gamma-alumina in water saturated with carbon dioxide. Again, it was found that the cooling rate fell with increasing alumina to water weight ratio. The results are shown in FIG. 3.

The reason for selecting the cooling rate at a workpiece temperature of 300° C. was that it is at approximately this temperature that the austenite to martensite transformation takes place. It is therefore particularly important that there should be slow cooling at around this temperature. The method according to the invention enables such slow cooling to be achieved, and the actual cooling rate to be tailored to the composition of the workpiece.

It was noted that when the workpiece was removed from the quench bath some of the alumina was dragged out with it. The amount of dragged out material visibly increased with increasing alumina but was easily removed by washing with water. At lower alumina concentrations, some gentle stirring was required to maintain the alumina in suspension.

Figure 4:
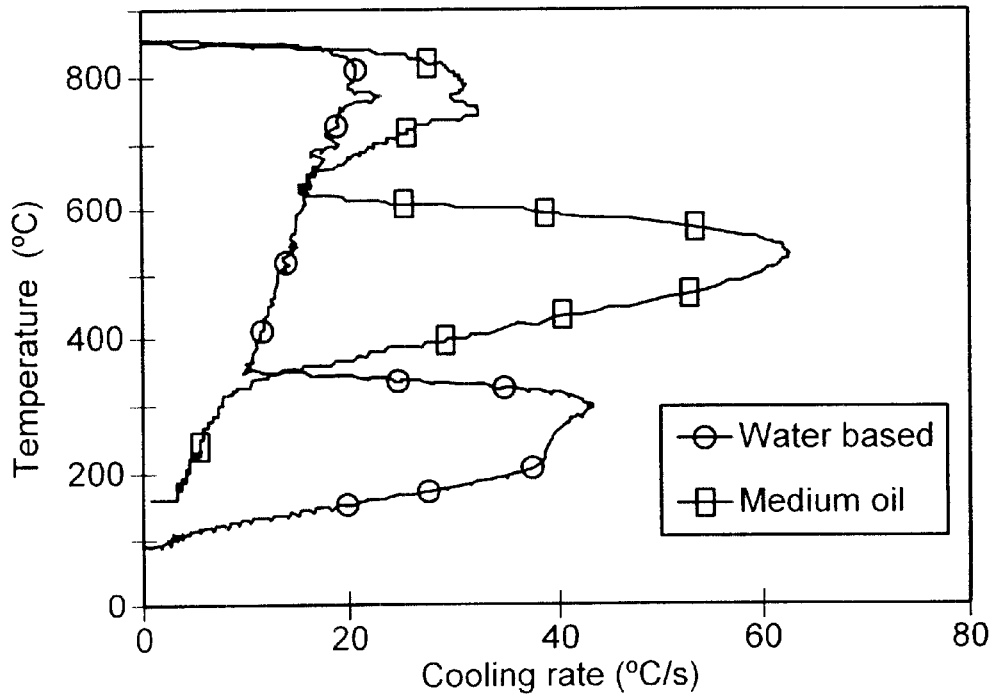
FIG. 4 is a graph showing the cooling rate as a steel workpiece is cooled from 850° C. to below 100° C. in a quenchant suitable for use in the invention and alternatively in a medium (viscosity) oil.

In a third set of experiments, the workpiece cooling curve was plotted for a quenchant according to the invention (a suspension of 0.05 micron particles of gamma-alumina in water having a weight ratio of 0.067:1, the water initially being at a temperature of 40° C. and being saturated at that temperature with carbon dioxide) and compared with the workpiece cooling curve for a medium oil quenchant. The two curves are shown in FIG. 4. The maximum cooling rate occurs at a much lower temperature with the quenchant according to the invention, than with the medium oil quenchant. Preferably, a higher concentration of alumina is selected so as to eliminate the peak in the cooling rate at approximately 300° C. It can be seen from FIG. 2 that alumina to water weight ratios of 0.10:1 can be used to achieve such a result.

The results presented above demonstrate that suspensions of inert particulate material in water are suitable quenchants for use in heat treatment processes. The suspension may be saturated with carbon dioxide.

What is claimed is:

1. A method of quenching a hot metal object formed of steel, comprising: saturating water with carbon dioxide, and immersing the hot metal object in a suspension of an essentially insoluble inorganic particulate material in the carbon dioxide saturated water, the suspension being initially at a temperature below 100° C.

2. The method of claim 1, wherein particles of the particulate material have a size in a range of 0.01 to 0.1 microns.

3. The method of claim 1, wherein the particulate material is a ceramic material.

4. The method of claim 1, wherein each 100 grammes of water of said suspension includes from 1 to 12 grammes of the particulate material in the suspension.

5. The method of claim 1, wherein the hot metal object is cooled in the suspension from a temperature greater than 850° C.

* * * * *